US011117729B2

(12) United States Patent
Uchida

(10) Patent No.: US 11,117,729 B2
(45) Date of Patent: Sep. 14, 2021

(54) CONTAINER WITH PARALLELPROTECTION MEMBERS

(71) Applicant: SAKAI DISPLAY PRODUCTS CORPORATION, Sakai (JP)

(72) Inventor: Takashi Uchida, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 0 days.

(21) Appl. No.: 16/645,454

(22) PCT Filed: Sep. 8, 2017

(86) PCT No.: PCT/JP2017/032465

§ 371 (c)(1),
(2) Date: Mar. 6, 2020

(87) PCT Pub. No.: WO2019/049311

PCT Pub. Date: Mar. 14, 2019

(65) Prior Publication Data

US 2020/0277122 A1 Sep. 3, 2020

(51) Int. Cl.

*B65D 81/113* (2006.01)
*B65D 85/48* (2006.01)
*B65D 85/68* (2006.01)

(52) U.S. Cl.

CPC ..... *B65D 81/113* (2013.01); *B65D 85/48* (2013.01); *B65D 85/68* (2013.01); *B65D 2585/6837* (2013.01)

(58) Field of Classification Search

CPC .... B65D 81/05; B65D 81/053; B65D 81/058; B65D 81/107; B65D 81/113; B65D 85/48;

(Continued)

(56) References Cited

U.S. PATENT DOCUMENTS 8,985,332 B2 * 3/2015 Kuo ..... B65D 11/10 206/454
9,010,534 B2 * 4/2015 Kuo ..... B65D 81/052 206/454

(Continued)

FOREIGN PATENT DOCUMENTS

CN 103523398 A 1/2014
CN 203581671 U * 5/2014

(Continued)

OTHER PUBLICATIONS

International Search Report for International Application No. PCT/JP2017/032465.

*Primary Examiner* — Bryon P Gehman
(74) *Attorney, Agent, or Firm* — ScienBiziP, P.C.

(57) ABSTRACT

A bottom surface member of a container defines an xy-plane, and a side surface member defines an xz-plane and aan yz-plane. A protective member includes a receiving part that has a first receiving surface parallel to the xz-plane and a second receiving surface parallel to the yz-plane, and a supporting part formed with the receiving part. The supporting part has a first flat plate section parallel to the xz-plane, a second flat plate section parallel to the yz-plane, and a third flat plate section parallel to the xy-plane. The receiving part has a fourth flat plate section that has the first receiving surface and is parallel to the xz-plane, a fifth flat plate section parallel to the yz-plane, a sixth flat plate section facing the fourth flat plate section with a gap therebetween, and a seventh flat plate section that has the second receiving surface.

12 Claims, 8 Drawing Sheets

(58) Field of Classification Search
CPC . B65D 85/68; B65D 2585/6837; B65D 85/30
USPC ..... 206/453, 454, 588
See application file for complete search history.

(56) References Cited

U.S. PATENT DOCUMENTS

| | | | | |
|---|---|---|---|---|
| 9,045,273 | B2 * | 6/2015 | Guo | B65D 81/056 |
| 10,457,464 | B2 * | 10/2019 | Lv | B65D 81/107 |
| 2014/0262927 | A1 | 9/2014 | Guo et al. | |

FOREIGN PATENT DOCUMENTS

| | | | |
|---|---|---|---|
| JP | S60-172677 | A | 9/1985 |
| JP | 2014-009020 | A | 1/2014 |
| JP | 3192245 | U | 8/2014 |

* cited by examiner (a)

(b)

(a)

(b)

(a)

(b)

(a)

(b)

(c)

CONTAINER WITH PARALLELPROTECTION MEMBERS

TECHNICAL FIELD

The present invention relates a container, for example, a container preferably usable to transport an object accommodated therein, and a protection member usable for the container.

BACKGROUND ART

For example, Patent Document No. 1 discloses a packaging member (i.e., container) usable to transport a display panel. The container disclosed in Patent Document No. 1 includes a corner protection member provided at a corner of a recessed portion that accommodates the display panel. The corner protection member is detachably fittable to a main body of the container and protects a corner of the display panel, which is an object to be accommodated. According to Patent Document No. 1, use of the corner protection member allows a common container main body and a common lid to be used regardless of whether a display panel having a circuit board connected therewith (hereinafter, may be referred to as a "display panel module") is to be accommodated or only a display panel is to be accommodated.

CITATION LIST

Patent Literature

Patent Document No. 1: Japanese Laid-Open Patent Publication No. 2014-9020

SUMMARY OF INVENTION

Technical Problem

However, in the case where the container described in Patent Document No. 1 is used, when, for example, a large acceleration is applied during the transportation of the display panel, a corner of the display panel is occasionally cracked. According to the studies made by the present inventor, this problem is caused because when a large acceleration (force) is applied to the corner protection member, the corner protection member rotates, as described below.

In the above, the container accommodating a display panel is described. However, this problem is not limited to occurring in the case where the container accommodates a display panel, but may occur in the case where the container accommodates a rectangular plate-like object formed of a material that is easily cracked or chipped away (e.g., a glass plate or a plastic plate).

The present invention has an object of providing a container and a protection member capable of, when a large acceleration is applied to an accommodated object, suppressing a corner of the accommodated object from being cracked or chipped away.

Solution to Problem

A container according to an embodiment of the present invention includes an accommodation member including a bottom surface member defining a bottom surface of an accommodation space having four corners and also including a side surface member defining side surfaces of the accommodation space, the bottom surface member defining an xy plane and the side surface member defining an xz plane and a yz plane both perpendicular to the xy plane; and two protection members each having a first receiving surface and a second receiving surface that are to be in contact with an object to be accommodated in the accommodation space, the first receiving surface being parallel to the xz plane and the second receiving surface being parallel to the yz plane. The side surface member includes two cutout portions respectively facing two corners adjacent to each other among the four corners of the accommodation space. Each of the two protection members includes a receiving portion having the first receiving surface and the second receiving surface and also includes a support portion formed integrally with the receiving portion. The support portion includes a first flat plate portion parallel to the xz plane and located so as to be in contact with a side surface, of the side surface member, that is parallel to the xz plane, a second flat plate portion crossing the first receiving surface and parallel to the yz plane, and a third flat plate portion provided on the first flat plate portion and the second flat plate portion and parallel to the xy plane. The receiving portion includes a fourth flat plate portion having the first receiving surface and parallel to the xz plane, a fifth flat plate portion parallel to the yz plane and located so as to be in contact with a side surface, of the side surface member, that is parallel to the yz plane, a sixth flat plate portion facing the fourth flat plate portion while having a space therebetween, and a seventh flat plate portion having the second receiving surface and parallel to the yz plane. A gap is formed between the seventh flat plate portion and the fourth flat plate portion.

In an embodiment, the first flat plate portion, the second flat plate portion, the third flat plate portion and the fourth flat plate portion define four surfaces of a generally parallelepiped first space.

In an embodiment, the fourth flat plate portion, the fifth flat plate portion, the sixth flat plate portion and the seventh flat plate portion define four side surfaces of a generally parallelepiped second space.

In an embodiment, the fifth flat plate portion, the sixth flat plate portion and the seventh flat plate portion each independently have a thickness that is less than a thickness of each of the first flat plate portion, the second flat plate portion and third flat plate portion.

In an embodiment, a groove is formed at a joint between the fourth flat plate portion and the fifth flat plate portion.

In an embodiment, the container further includes a first filling member located in the first space.

In an embodiment, the first filling member is formed integrally with the accommodation member.

In an embodiment, the container further includes a second filling member located in the second space.

In an embodiment, the second filling member is formed integrally with the accommodation member.

In an embodiment, the accommodation member is formed of an expanded plastic material.

In an embodiment, the protection member is formed of a non-expanded plastic material.

In an embodiment, the container further includes a protection sheet provided on each of the first and second receiving surfaces of the protection member, wherein the protection sheet is formed of a non-expanded plastic material harder than the inner member.

A protection member according to an embodiment of the present invention is usable for the container described in any one of the above.

Advantageous Effects of Invention

An embodiment of the present invention provides a container and a protection member capable of, when a large acceleration is applied to an accommodated object, suppressing a corner of the accommodated object from being cracked or chipped away.

DESCRIPTION OF EMBODIMENTS

Figure 11:
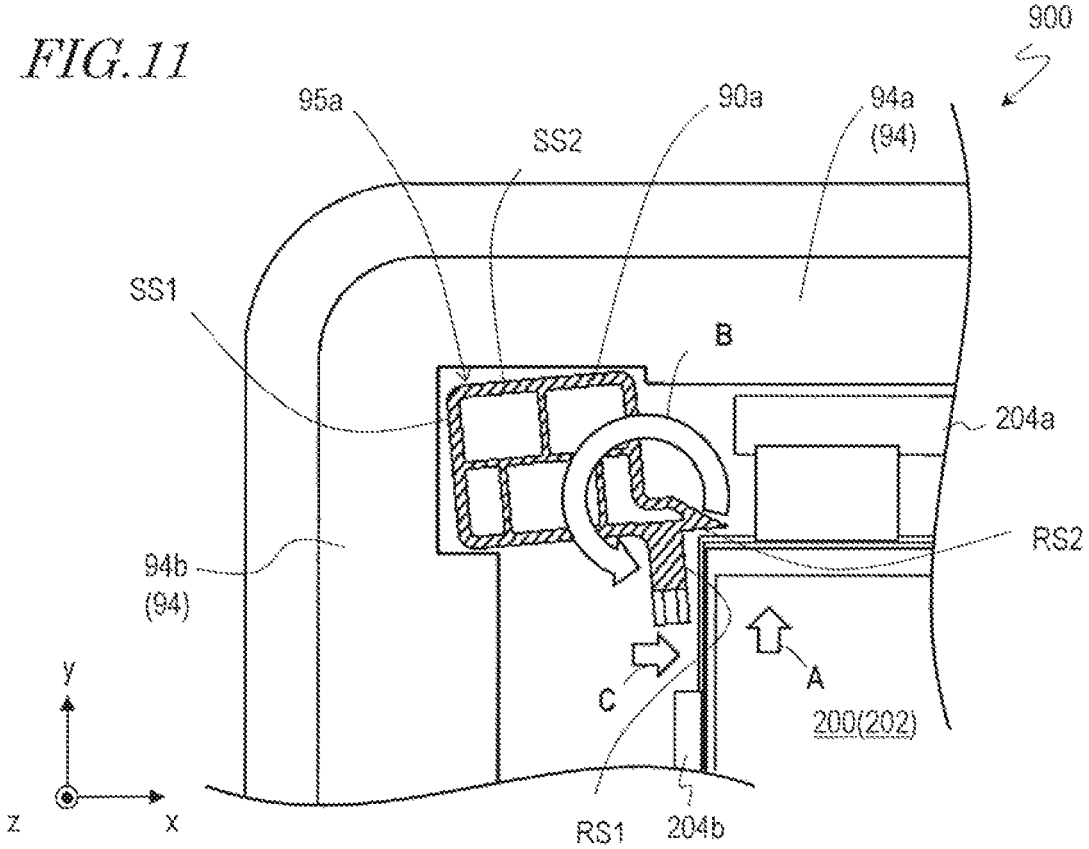
FIG. 11 is a schematic plan view of a container 900 in a comparative example and is provided to describe a problem caused by a protection member 90*a*.

First, with reference to FIG. 11, the above-described problem of the conventional container, including the corner protection member, described in Patent Document No. 1 will be described. FIG. 11 is a schematic perspective view of a container 900 including a protection member 90*a* having substantially the same structure as that of the corner protection member described in Patent Document No. 1.

The container 900 includes the protection member 90*a* detachably located in a cutout portion 95*a* of side surface member 94 (94*a*, 94*b*). The protection member 90*a* is integrally formed of a non-expanded resin. Two receiving surfaces RS1 and RS2 of the protection member 90*a* are in contact with a corner of a panel module 200, and thus the protection member 90*a* holds the panel module 200 such that the panel module 200 does not move in an xy plane. The receiving surface RS1 is parallel to a yz plane, whereas the receiving surface RS2 is parallel to an xz plane. The panel module 200 includes, for example, a source driver circuit board 204*a* and a gate driver 204*b*.

When, for example, an acceleration is applied to the panel module 200 in a y direction represented by arrow A as shown in FIG. 11, a force acts on the protection member 90*a* to rotate the protection member 90*a* counterclockwise as represented by arrow B. The protection member 90*a* is molded to have a high rigidity and therefore, rotates integrally (arrow B). The side surface member 94*a* of the container 900 is formed of an expanded resin, and the protection member 90*a* is formed of a material harder than that of the side surface member 94*a*. Therefore, the side surface member 94*a* may possibly be crushed by the protection member 90*a*. When the protection member 90*a* rotates, a portion of the protection member 90*a* that has the receiving surface RS1 collides against a side, of the panel module 200, along which the gate driver is mounted (arrow C). This increases the frequency at which a glass substrate forming the panel is cracked or chipped away.

A container according to an embodiment of the present invention solves the problem that when a large acceleration is applied to an accommodated object, a corner of the accommodated object is cracked or chipped away.

Hereinafter, a container according to an embodiment of the present invention will be described with reference to the drawings. In the following, a container that accommodates a liquid crystal display panel module will be described as an example. An embodiment of the present invention is not limited to the following example. It should be noted that an embodiment of the present invention is directed to a container preferably usable to accommodate an object, like a liquid crystal display panel module, that cannot be supported by four sides but needs to be supported at corners and is formed of a material that is easily cracked or chipped away (glass or a plastic material). An embodiment of the present invention is especially directed to a container preferably usable to transport a liquid crystal display panel module.

Figure 1:
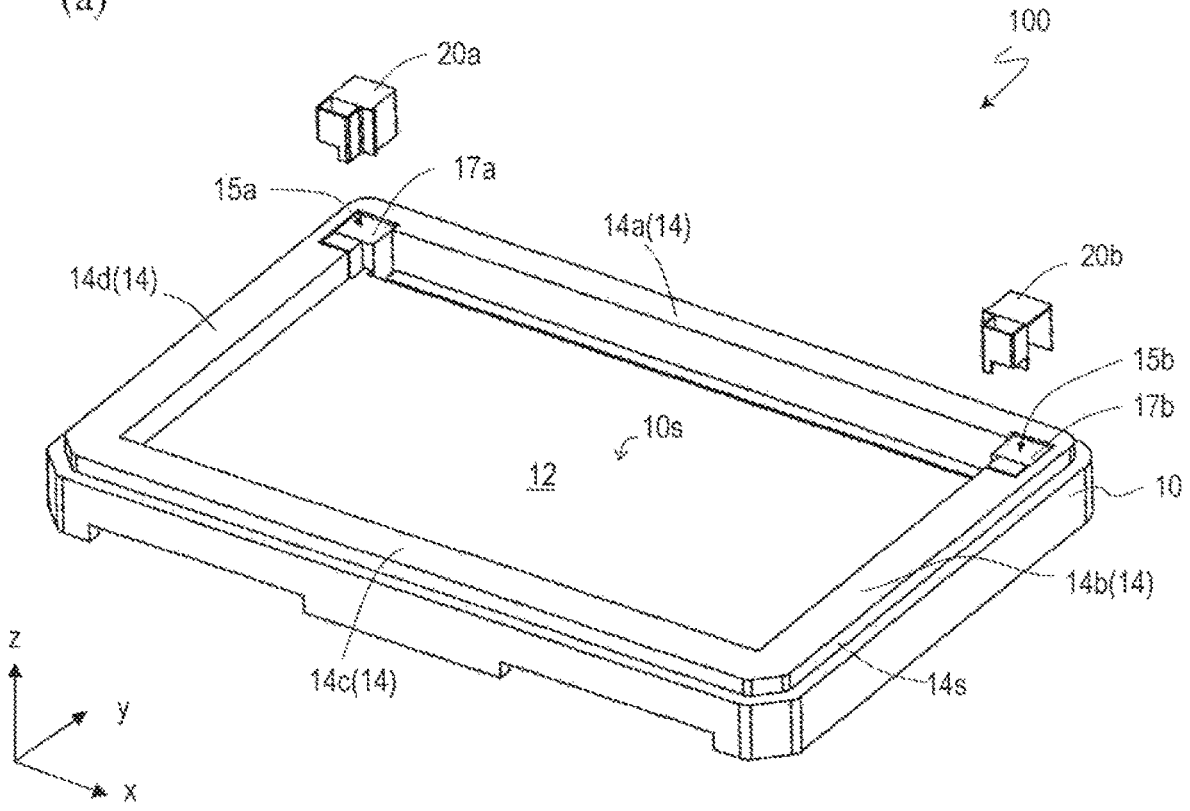
FIG. 1(*a*) is a schematic perspective view of a container 100 according to an embodiment of the present invention, and FIG. 1(*b*) is a schematic perspective view of a liquid crystal display panel module 200 to be accommodated in the container 100.
Figure 1:
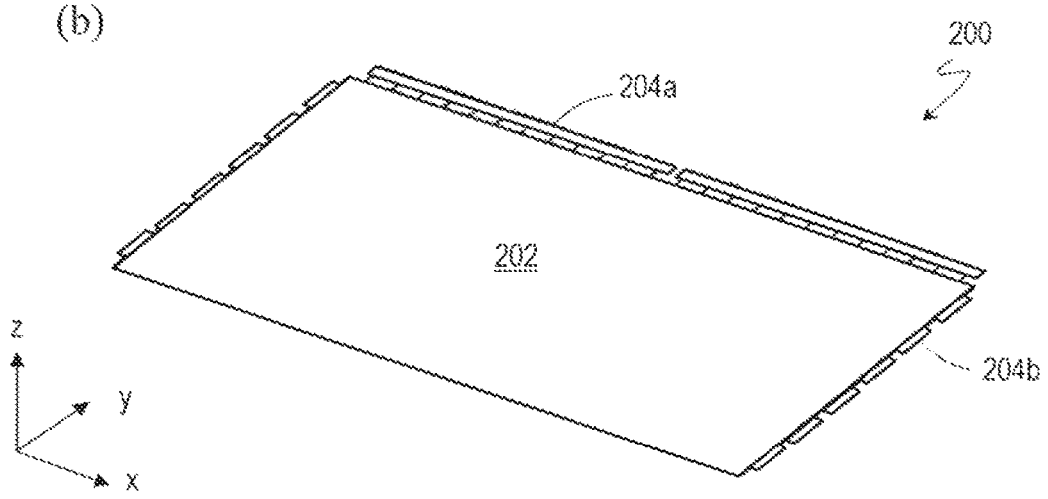

FIG. 1(*a*) is a schematic perspective view of a container 100 according to an embodiment of the present invention. FIG. 1(*b*) is a schematic perspective view of a liquid crystal display panel module (hereinafter, referred to as a "panel module") 200, which is to be accommodated in the container 100.

The container 100 includes an accommodation member 10 including a bottom surface member 12 defining a bottom surface of an accommodation space 10*s* and a side surface member 14 (14*a*, 14*b*, 14*c* and 14*d*) defining side surfaces of the accommodation space 10*s*, and also includes protection members 20*a* and 20*b* located in the accommodation space 10*s* and having receiving surfaces that are to be in contact with an object to be accommodated in the accommodation space 10*s*. The accommodation space 10*s* has four corners. The side surface member 14 includes two cutout portions 15*a* and 15*b* respectively facing two corners adjacent to each other among the four corners. Herein, the side surface member 14 includes the two cutout portions 15*a* and 15*b* facing each other while having, therebetween, a side of a liquid crystal display panel (hereinafter, referred to as a "panel") 202 of the panel module 200, the side being a side along which the source driver circuit board 204*a* is mounted. Needless to say, cutout portions may be provided so as to respectively face the four corners. The protection members 20*a* and 20*b* are respectively located in the cutout portions 15*a* and 15*b*. Optional filling members 17*a* and 17*b* are provided in the cutout portions 15*a* and 15*b*. The bottom surface member 12 defines the xy plane, and the side surface member 14 defines the xz plane and the yz plane both perpendicular to the xy plane.

The panel module 200 is located in the accommodation space 10*s* of the container 100. A plurality of (e.g., 10 to 20) panel modules 200 may be located in a stacked manner. In this case, a cushioning sheet (e.g., expanded polyethylene (EPE) sheet; thickness: for example, 1 mm) may be held between the panel modules 200. It is preferred that the cushioning sheet is smaller by several millimeters to about 10 mm than an outer shape of the panel 202.

Figure 2:
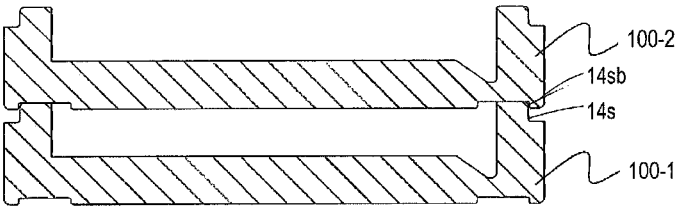
FIG. 2(*a*) is a schematic cross-sectional view showing a state in which a plurality of the containers 100 are stacked, and FIG. 2(*b*) is a schematic cross-sectional view showing a state in which a lid is located.
Figure 2:
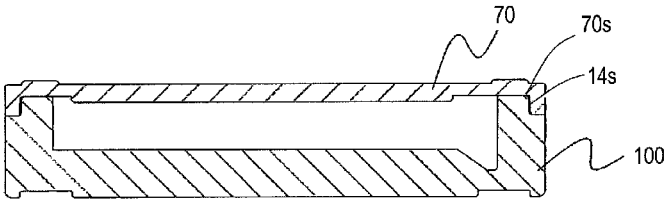

As shown in FIG. 2(*a*), another container 100-2 may be stacked on a container 100-1 accommodating the panel module(s) 200. It is preferred that as shown here as an example, a bottom surface of the side surface member 14 of the container 100 has a stepped portion 14*sb* engageable with a stepped portion 14*s* provided at a top surface of the side surface member 14. The stepped portion 14*sb* may be formed as a part of a recessed portion. As shown in FIG. 2(*b*), a lid 70 having a stepped portion 70*s* engageable with the stepped portion 14*s* provided at the top surface of the side surface member 14 may be prepared when necessary. The stepped portion 70*s* may be formed as a part of a recessed portion. The lid 70 may be formed of the same material as that of the accommodation member 10.

Figure 3:
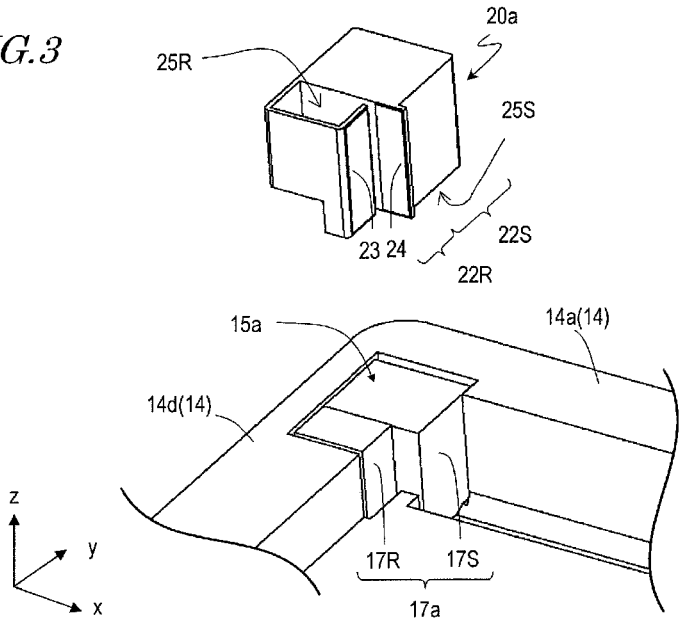
FIG. 3 is a schematic perspective view showing how a protection member 20*a* is attached to a cutout portion 15*a* of an accommodation member 10 of the container 100.
Figure 4:
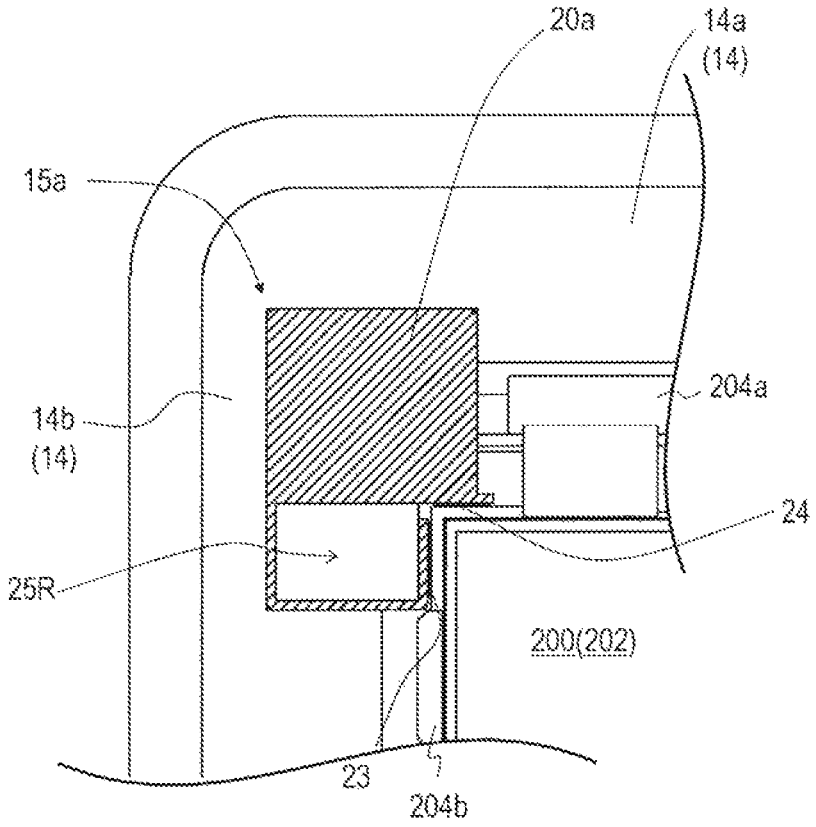
FIG. 4 is a schematic plan view showing a state in which the protection member 20*a* is attached to the cutout portion 15*a* of the accommodation member 10 of the container 100.

Now, FIG. 3 and FIG. 4 will be referred to. FIG. 3 is a schematic perspective view showing how the protection member 20*a* is attached to the cutout portion 15*a* of the accommodation member 10 of the container 100. FIG. 4 is a schematic plan view showing a state in which the protection member 20*a* is attached to the cutout portion 15*a* of the accommodation member 10 of the container 100. The protection member 20*b* to be attached to the contact portion 15*b* has a shape symmetrical to that of the protection member 20*a* (the plane of symmetry is parallel to the yz plane). Thus, the protection member 20*a* will be described as an example, hereinafter.

The protection member 20*a* includes a receiving portion 22R having a first receiving surface 24 and a second receiving surface 23 to be in contact with the panel module 200, and also includes a support portion 22S formed integrally with the receiving portion 22R. The receiving portion 22R defines a generally parallelepiped space 25R, and the support portion 22S defines a generally parallelepiped space 25S. A structure of the protection member 20*a* will be described below in detail with reference to FIG. 5 through FIG. 8.

Figure 5:
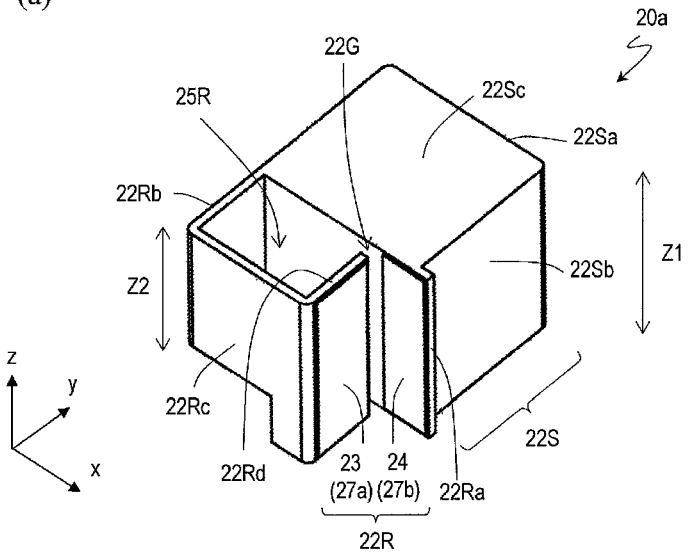
FIG. 5(*a*) is a schematic perspective view of the protection member 20*a* as seen from above, and FIG. 5(*b*) is a schematic perspective view of the protection member 20*a* as seen from below.
Figure 5:
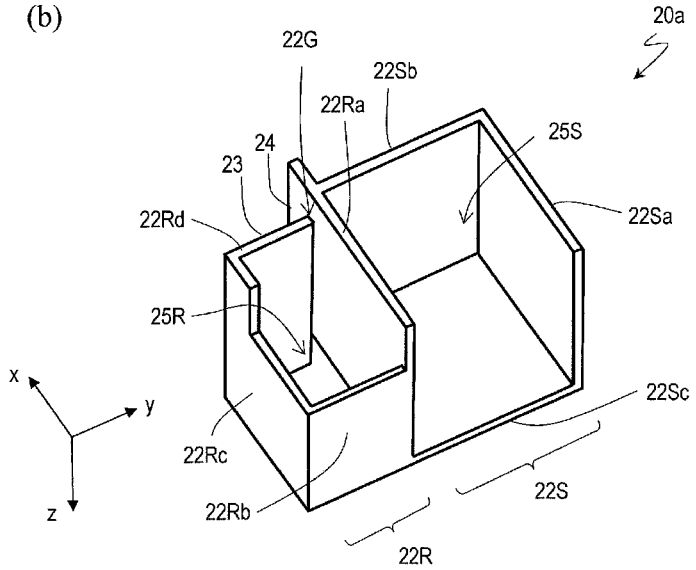

The protection member 20*a* has a generally parallelepiped shape as a whole, and has side surfaces parallel to the xz plane and the yz plane (see 22Rc and 22Rb in FIG. 5(*a*)). The protection member 20*a* is located in the cutout portion 15*a* as being detachable in a z direction, such that the side surfaces thereof parallel to the xz plane and the yz plane are in contact with side surfaces of the cutout portion 15*a* that are parallel to the xz plane and the yz plane.

The optional filling member 17*a* is provided in the cutout portion 15*a*. The filling member 17*a* includes, for example, a filling member 17R filling the space 25R of the receiving portion 22R and a filling member 17S filling the space 25S of the support portion 22S. When the protection member 20*a* is attached to the cutout portion 15*a*, the spaces 25R and 25S are respectively filled with the filling members 17R and 17S, and inner surfaces of the protection member 20*a* are in contact with surfaces of the filling member 17*a*. In this state, a force received by the protection member 20*a* from the panel module 200 is dispersed. As a result, a force of the protection member 20*a* that deforms the side surface member 14 is decreased, which suppresses the deformation of the side surface member 14 (see FIG. 10). The filling member 17*a* may be omitted. FIG. 4 does not show the filling member 17*a*. The filling member 17*a* may include only one of the filling members 17R and 17S.

With reference to FIG. 5 through FIG. 8, the structure of the protection member 20*a* will be described in detail.

Figure 6:
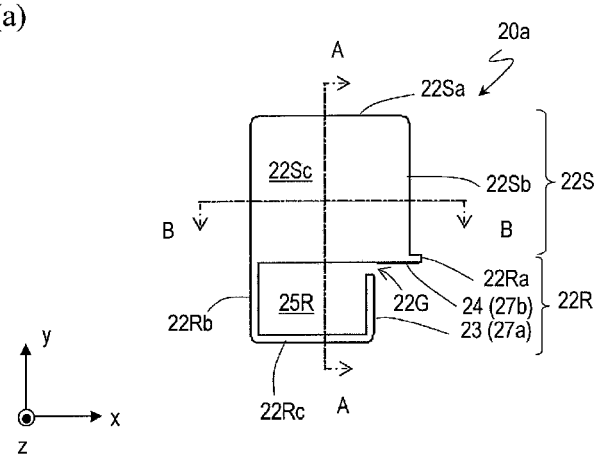
FIG. 6(*a*) is a schematic plan view of the protection member 20*a*, and FIG. 6(*b*) and FIG. 6(*c*) are each a schematic side view of the protection member 20*a*.
Figure 6:
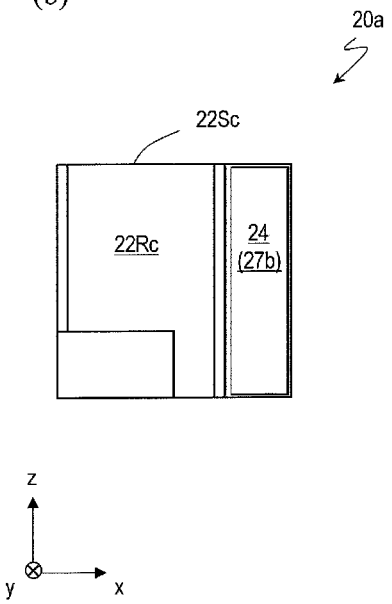
Figure 6:
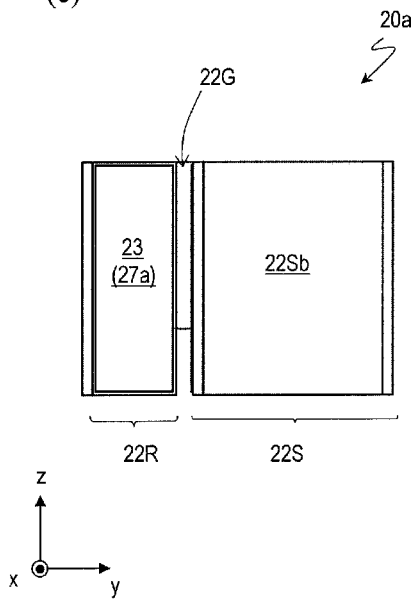
Figure 7:
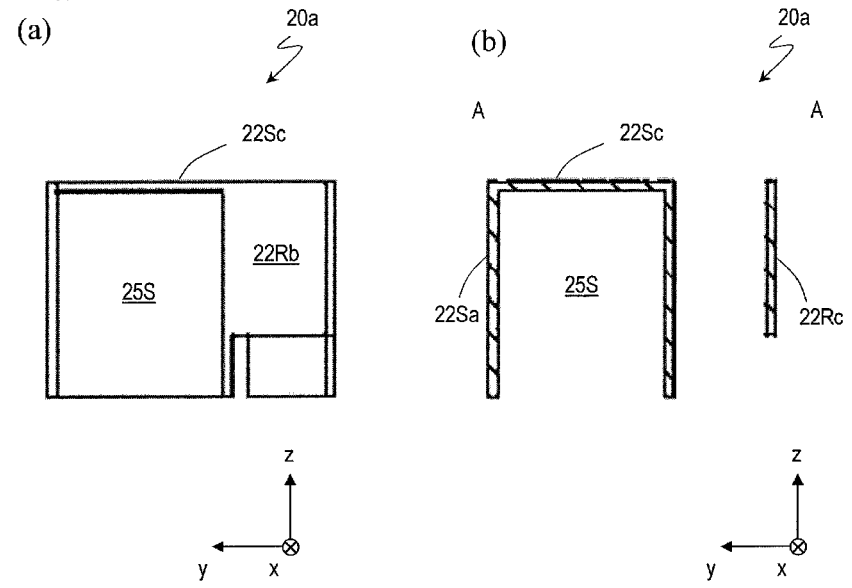
FIG. 7(*a*) is a schematic side view of the protection member 20*a*, and FIG. 7(*b*) is a schematic cross-sectional view of the protection member 20*a*.
Figure 8:
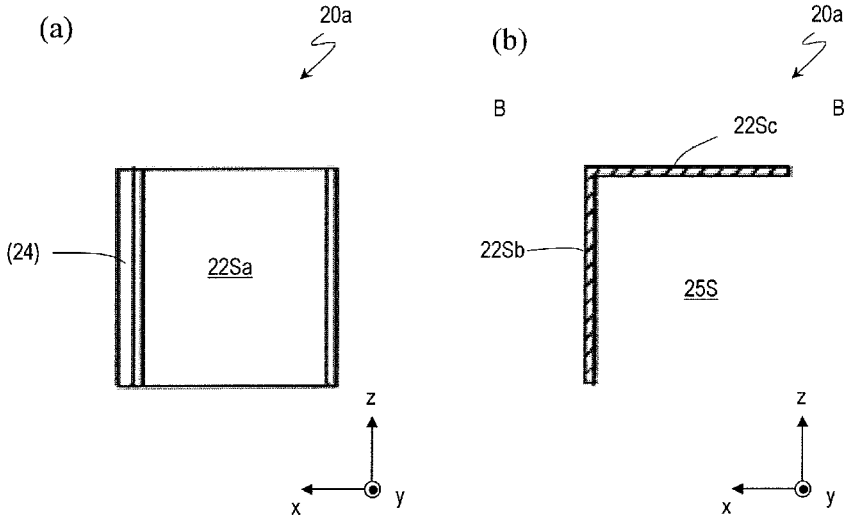
FIG. 8(*a*) is a schematic side view of the protection member 20*a*, and FIG. 8(*b*) is a schematic cross-sectional view of the protection member 20*a*.

FIG. 5(*a*) is a schematic perspective view of the protection member 20*a* as seen from above, and FIG. 5(*b*) is a schematic perspective view of the protection member 20*a* as seen from below. FIG. 6(*a*) is a schematic plan view of the protection member 20*a*, and FIG. 6(*b*) and FIG. 6(*c*) are each a schematic side view of the protection member 20*a*. FIG. 7(*a*) is a schematic side view of the protection member 20*a*, and FIG. 7(*b*) is a schematic cross-sectional view of the protection member 20*a* taken along line A-A in FIG. 6(*a*). FIG. 8(*a*) is a schematic side view of the protection member 20*a*, and FIG. 8(*b*) is a schematic cross-sectional view of the protection member 20*a* taken along line B-B in FIG. 6(*a*).

First, FIG. 5(*a*) and FIG. 5(*b*) will be referred to.

The protection member 20*a* includes the receiving portion 22R having the first receiving surface 24 parallel to the xz plane and the second receiving surface 23 parallel to the yz plane, and also includes the support portion 22S formed integrally with the receiving portion 22R. Optional protection sheets 27*b* and 27*a* are respectively provided on the first receiving surface 24 and the second receiving surface 23. The protection sheets 27*a* and 27*b* may be omitted.

The support portion 22S includes a first flat plate portion 22Sa parallel to the xz plane and located so as to be in contact with a side surface of the side surface member 14 that is parallel to the xz plane, a second flat plate portion 22Sb crossing the first receiving surface 24 and parallel to the yz plane, and a third flat plate portion 22Sc provided on the first flat plate portion 22Sa and the second flat plate portion 22Sb and parallel to the xy plane.

The receiving portion 22R includes a fourth flat plate portion 22Ra having the first receiving surface 24 and parallel to the xz plane, a fifth flat plate portion 22Rb parallel to the yz plane and located so as to be in contact with a side surface of the side surface member 14 that is parallel to the yz plane, a sixth flat plate portion 22Rc facing the fourth flat plate portion 22Ra while having a space therebetween, and a seventh flat plate portion 22Rd having the second receiving surface 23 and parallel to the yz plane. A gap 22G is formed between the seventh flat plate portion 22Rd having the second receiving surface 23 and the fourth flat plate portion 23Ra having the first receiving surface 24.

As can be seen, the protection member 20*a* includes seven flat plate portions. Among the seven flat plate portions, the seventh flat plate portion 22Rd having the second receiving surface 23 and the fourth flat plate portion 23Ra having the first receiving surface 24 have the gap 22G formed therebetween. Therefore, when an acceleration is applied to the first receiving surface 24, the second receiving surface 23 is suppressed from moving integrally with the first receiving surface 24. As a result, the corner of the display panel is suppressed from being cracked or chipped away, which would be caused by a rotation of the protection member 20*a* (described below with reference to FIG. 10).

The first flat plate portion 22Sa, the second flat plate portion 22Sb, the third flat plate portion 22Sc and the fourth flat plate portion 22Ra each independently have a thickness of, for example, 2 mm or greater and 3 mm or less. The fifth flat plate portion 22Rb, the sixth flat plate portion 22Rc and the seventh flat plate portion 22Rd each independently have a thickness of, for example, 1 mm or greater and 2 mm or less. The gap 22G has a length of, for example, 2 mm or longer and 4 mm or shorter. It is preferred that the thicknesses of the fifth flat plate portion 22Rb, the sixth flat plate portion 22Rc and the seventh flat plate portion 22Rd are each independently less than the thickness of each of the first flat plate portion 22Sa, the second flat plate portion 22Sb, the third flat plate portion 22Sc and the fourth flat plate portion 22Ra. With such an arrangement, when, for example, an acceleration is applied to the first receiving surface 24, a force that rotates the support portion 22S is made difficult to be transmitted to the seventh flat plate portion 22Rd of the receiving portion 22R. In the meantime, the first receiving surface 24 may have a sufficient rigidity.

Height Z2 of the fifth flat plate portion 22Rb is shorter than height Z1 of each of the first flat plate portion 22Sa, the second flat plate portion 22Sb and the fourth flat plate portion 22Ra. With such an arrangement, the force applied to the first receiving surface 24 is made difficult to be transmitted to the seventh flat plate portion 22Rd of the receiving portion 22R via the fifth flat plate portion 22Rb. The sixth flat plate portion 22Rc includes a rectangular cutout portion so as to have a side having the height Z1 and a side having the height 22. The cutout portion is not limited to having such a shape, and may have a shape inclining continuously and mildly.

As shown in FIG. 5(*b*), in the support portion 22S, the first flat plate portion 228*a*, the second flat plate portion 22Sb, the third flat plate portion 228*c* and the four flat plate portion 22Ra define four surfaces of the generally parallelepiped space 25S. The space 25S may be filled with the filling member 17S (see, for example, FIG. 3).

As shown in FIG. 5(*a*), in the receiving portion 22R, the fourth flat plate portion 22Ra, the fifth flat plate portion 22Rb, the sixth flat plate portion 22Rc and the seventh flat plate portion 22Rd define four side surfaces of the generally parallelepiped space 25R. The space 25R may be filled with the filling member 17R (see, for example, FIG. 3).

It is preferred that the filling members 17R and 17S are, for example, formed of the same material as that of the accommodation member 10 and formed integrally with the accommodation member 10. Since the filling members 17R and 17S themselves are secured to the accommodation member 10, the protection member 20*a* is further suppressed from being deformed and/or moved (rotated). The filling members 17R and 17S may be prepared as members separate from the accommodation member 10. In this case also, it is preferred that the filling members 17R and 17S are formed of, for example, the same material as that of the accommodation member 10.

Regarding a more detailed structure of the protection member 20*a*, refer to FIG. 6(*a*), FIG. 6(*b*), FIG. 6(*c*), FIG. 7(*a*), FIG. 7(*b*), FIG. 8(*a*) and FIG. 8(*b*). FIG. 6(*a*) is a schematic plan view of the protection member 20*a*, and FIG. 6(*b*) and FIG. 6(*c*) are each a schematic side view of the protection member 20*a*. FIG. 7(*a*) is a schematic side view of the protection member 20*a*, and FIG. 7(*b*) is a schematic cross-sectional view of the protection member 20*a* (line A-A in FIG. 6(*a*)). FIG. 8(*a*) is a schematic side view of the protection member 20*a*, and FIG. 8(*b*) is a schematic cross-sectional view of the protection member 20*a* (line B-B in FIG. 6(*a*)).

Figure 9:
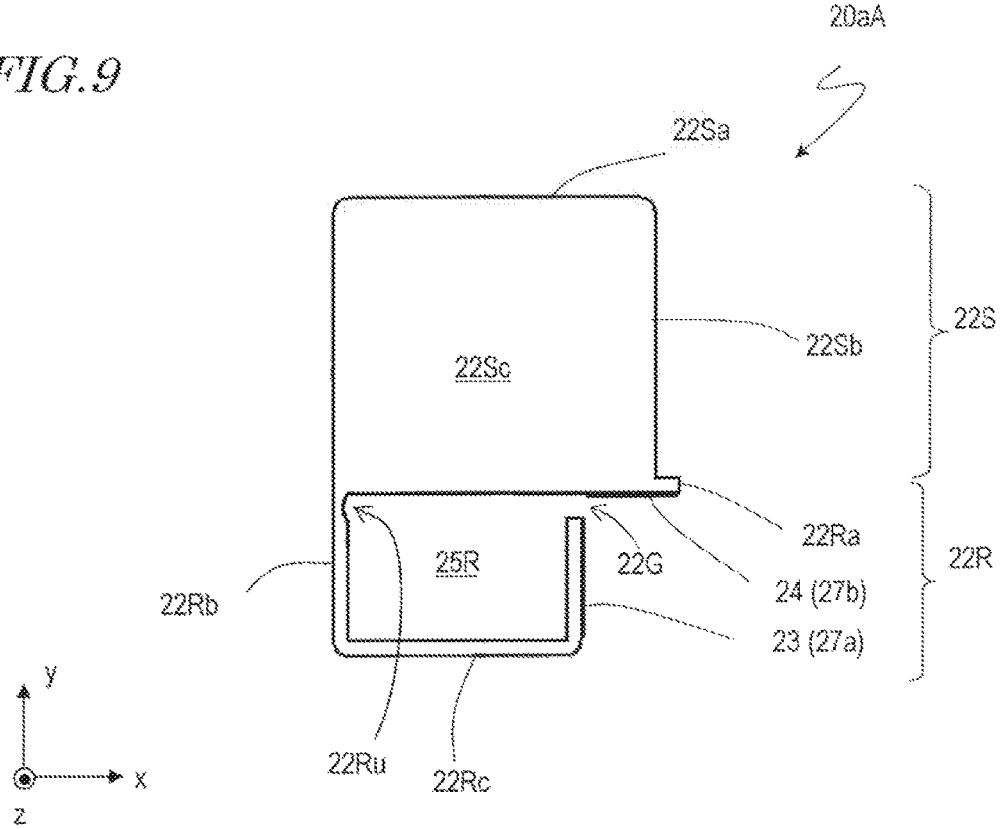
FIG. 9 is a schematic plan view of another protection member 20*a*A.

Now, a structure of another protection member 20*a*A will be described with reference to FIG. 9. Unlike the protection member 20*a* described above, the protection member 20*a*A includes a groove 22Ru at a joint of the fourth flat plate portion 22Ra and the fifth flat plate portion 22Rb. When, for example, an acceleration is applied to the first receiving surface 24, the provision of the groove 22Ru provided at the joint of the fourth flat plate portion 22Ra and the fifth flat plate portion 22Rb makes it difficult to transmit a force that rotates the support portion 22S to the receiving portion 22R. It is preferred that the groove 22Ru has, for example, a U-shaped cross-section from the point of view of the tolerance to repetition.

An effect substantially the same as that described above regarding the protection member 20*a* is provided by an arrangement in which the thicknesses of the fifth flat plate portion 22Rb, the sixth flat plate portion 22Rc and the seventh flat plate portion 22Rd are each independently less than the thickness of each of the first flat plate portion 22Sa, the second flat plate portion 22Sb and the third flat plate portion 22Sc. In the case where the groove 22Ru is provided, it is not necessary that the thicknesses of the fifth flat plate portion 22Rb, the sixth flat plate portion 22Rc and the seventh flat plate portion 22Rd are each less than the thickness of each of the first flat plate portion 22Sa, the second flat plate portion 22Sb and the third flat plate portion 22Sc.

Now, with reference to FIG. 10, it will be described that when a large acceleration is applied to an object accommodated in the container 100 according to an embodiment of the present invention, the protection member 20*a*A included in the container 100 suppresses a corner of the object from being cracked or chipped away. Needless to say, a protection member having a structure symmetrical to the protection member 20*a*A (the plane of symmetry is the yz plane) is used as the protection member 20*b* shown in FIG. 1(*a*).

Figure 10:
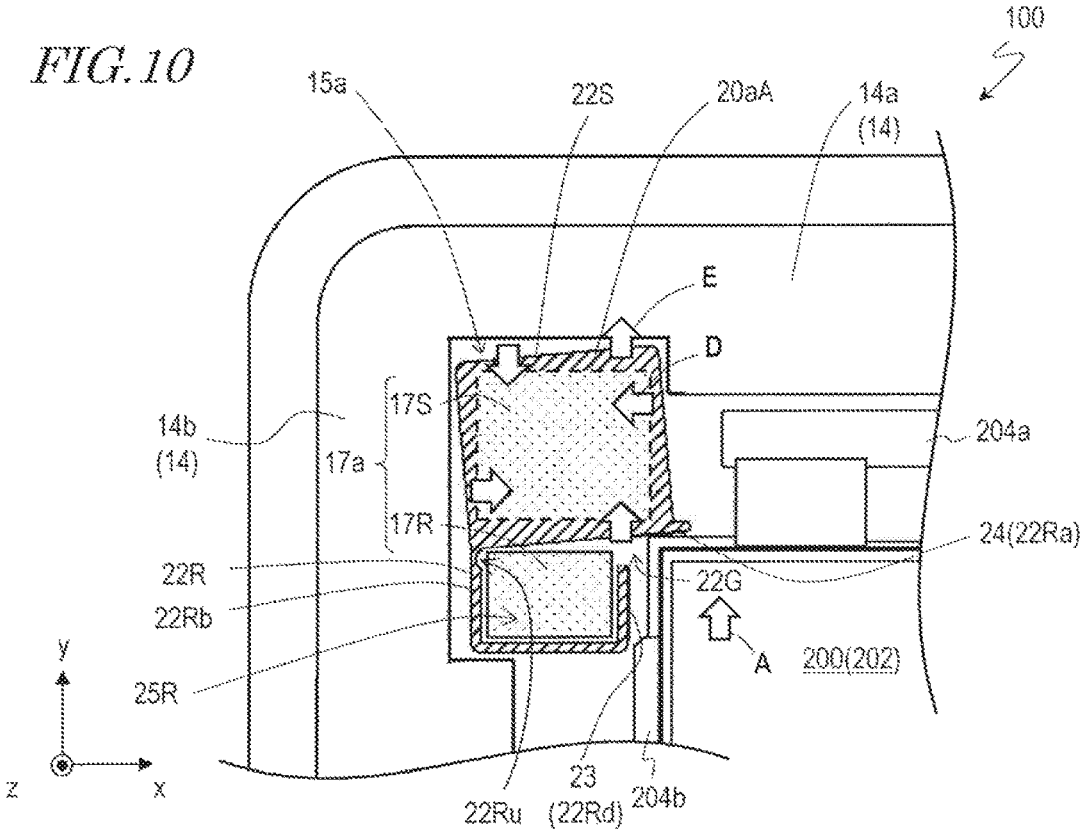
FIG. 10 is a schematic plan view of the container 100, and schematically shows a state of the protection member 20*a*A when an acceleration is applied to the protection member 20*a*A from the panel module 200.

FIG. 10 is a schematic plan view of the container 100, and schematically shows a state of the protection member 20*a*A when an acceleration is applied to the protection member 20*a*A from the panel module 200. In FIG. 10, the filling member 17R is omitted, and the clearance between the cutout portion 15*a* and the protection member 20*a*A is shown larger. In actuality, it is preferred that the clearance between the cutout portion 15*a* and the protection member 20*a*A is small. For example, the protection member 20*a*A and the side surfaces of the cutout portion 15*a* may be in contact with each other as long as the protection member 20*a*A is easily detached from the cutout portion 15*a* while being nipped by a hand of a user. The clearance between one of the receiving surfaces 23 and 24 of the protection member 20*a*A and the panel module 200 is, for example, about 1 mm to about 3 mm in the case where, for example, the panel module 200 is of a 60-inch type. The clearance may be set to be small as described above, so that the range in which the panel module 200 is movable in a plane parallel to the xy plane while being transported is limited to be small.

As schematically shown in FIG. 10, when an acceleration is applied to the panel module 200 in the y direction represented by arrow A and a force that rotates the protection member 20*a*A counterclockwise is applied to the first receiving surface 24 of the protection member 20*a*A, the support portion 22S is moved to rotate counterclockwise. At this point, even if the support portion 22S rotates, the receiving portion 22R does not rotate almost at all. The gap 22G is formed between the seventh flat plate portion 22Rd having the second receiving surface 23 and the fourth flat plate portion 22Ra having the first receiving surface 24, and therefore, the force received by the first receiving surface 24 is difficult to be directly transmitted to the second receiving surface 23. In addition, the groove 22Ru is provided at the joint between the fourth flat plate portion 22Ra and the fifth flat plate portion 22Rb. Therefore, when the acceleration is applied to the first receiving surface 24, the force that rotates the support portion 22S is more difficult to be transmitted to the receiving portion 22R. As a result, the seventh flat plate portion 22Rd having the second receiving surface 23 is suppressed from colliding against the corner of the panel module 200.

In addition, the space 25R of the receiving portion 22R of the protection member 20*a*A is filled with the filling member 17R, and the space 25S of the support portion 22S is filled with the filling member 17S. Therefore, the force (arrow A) received by the protection member 20*a*A from the panel module 200 is dispersed (arrows D) by the filling member 17S in contact with inner surfaces of the protection member 20*a*A. As a result, the force (arrow E) of the protection member 20*a*A that deforms the side surface member 14 is decreased, which may suppress the deformation of the side surface member 14.

As described above with reference to FIG. 11, the protection member 90*a* included in the container 900 in the comparative example is molded to have a high rigidity. Therefore, as a result of the protection member 90*a* rotating integrally, a portion of the protection member 90*a* that has the receiving surface RS1 collides against a side of the panel module 200, which increases the frequency at which the glass substrate forming the panel is cracked or chipped away.

Now, preferred materials for each of the components of the container 100 will be described. The materials described below are preferred examples of materials for the container 100 transporting the panel module 200, and the preferred materials are not limited to those described below.

The accommodation member 10 (bottom surface member 12 and side surface member 14), the filling member 17*a* and the protection member 20*a* (20*a*A) may all be formed of a plastic material. A plastic material preferably usable for these components is any of various known plastic materials (thermoplastic resins). Examples of the usable plastic material include polyolefins such as polyethylene, polypropylene and the like, polystyrenes, and mixtures (blends) thereof. These plastic materials in an expanded form are also usable.

For the accommodation member 10, a material having a large effect of absorbing an impact during the transportation is preferred. The accommodation member 10 is preferably formed of an expanded plastic material. For the protection member 20*a*, which directly receives a force from the panel module 200 (panel 202), a material harder than the material of the accommodation member 10 is preferred. The protection member 20*a* is preferably formed of a non-expanded plastic material. The protection sheets 27*a* and 27*b* are preferably formed of a non-expanded plastic material harder than the material of the protection member 20*a*.

For example, the protection member 20*a* is formed of, preferably, non-expanded polyethylene, and more preferably, high density polyethylene from the point of view of the hardness. The protection member 20*a* may be formed of polycarbonate. The protection sheets 27*a* and 27*b* are in direct contact with, for example, a glass substrate of the panel module 200 (panel 202) and therefore, is preferably formed of polycarbonate or hard rubber, each of which is highly abrasion resistant.

The accommodation member 10 is preferably formed of expanded polyethylene (EPE), expanded polypropylene (EPP) or expanded polystyrene (EPS, also referred to as "styrofoam"). Among these materials, expanded polystyrene (EPS) is most preferable from the point of view of cost performance. It should be noted that in order to transport the panel module 200 more safely, it is especially preferred to use expanded polystyrene expanded at a ratio lower than that of commonly and widely used expanded polystyrene (expansion ratio: about 70 times), for example, expanded polystyrene expanded at a ratio of about 20 times to about 50 times. The filling member 17*a* may be formed of the same material as that of the accommodation member 10. The filling member 17*a* may be formed integrally with the bottom surface member 12.

The above-described materials have been selected based on results of a vibration test and an impact test. For the vibration test and the impact test, a state in which 20 liquid crystal display panel modules (60-inch type) were accommodated in the container 100 produced with each of various materials was simulated. With the above-described materials, the liquid crystal display panel modules may be transported very safely. Namely, the liquid crystal display panel modules may be suppressed from being broken during the transportation. The 60-inch liquid crystal display panel modules used for the tests had a size of about 1300 mm×about 800 mm. The container 100 had an outer shape of about 1500 mm to about 1600 mm×about 900 mm to about 1000 mm and a height of about 120 mm to about 150 mm. In order to increase the strength, the outer shape of the container 100 may be increased. In order to increase the transportation efficiency and decrease the cost, the outer shape of the container 100 may be decreased. The material of each of the components may be selected from the above-listed materials, and the size of each of the components may be optimized, in accordance with the use.

INDUSTRIAL APPLICABILITY

An embodiment of the present invention is directed to a container preferably usable to, for example, transport an object accommodated therein.

REFERENCE SIGNS LIST

10 accommodation member
10*s* accommodation space
12 bottom surface member
14, 14*a*, 14*b*, 14*c*, 14*d* side surface member
14*s* stepped portion
15*a*, 15*b* cutout portion
20*a*, 20*b* protection member
22R receiving portion
22Rb fifth flat plate portion
22Ru groove
22S support portion
22Sa first flat plate portion
22Sb second flat plate portion
23, 24 receiving surface
100 container
200 liquid crystal display panel module
202 liquid crystal display panel
204*a* source driver circuit board
204*b* gate driver

The invention claimed is:

1. A container, comprising:

an accommodation member including a bottom surface member defining a bottom surface of an accommodation space having four corners and also including a side surface member defining side surfaces of the accommodation space, the bottom surface member defining an xy plane and the side surface member defining an xz plane and an yz plane both perpendicular to the xy plane; and two protection members each having a first receiving surface and a second receiving surface that are to be in contact with an object to be accommodated in the accommodation space, the first receiving surface being parallel to the xz plane and the second receiving surface being parallel to the yz plane, wherein the side surface member includes two cutout portions respectively facing two corners adjacent to each other among the four corners of the accommodation space, wherein each of the two protection members includes a receiving portion having the first receiving surface and the second receiving surface and also includes a support portion formed integrally with the receiving portion;

wherein the support portion includes a first flat plate portion parallel to the xz plane and located so as to be in contact with a side surface, of the side surface member, that is parallel to the xz plane, a second flat plate portion crossing the first receiving surface and parallel to the yz plane, and a third flat plate portion provided on the first flat plate portion and the second flat plate portion and parallel to the xy plane;

wherein the receiving portion includes a fourth flat plate portion having the first receiving surface and parallel to the xz plane, a fifth flat plate portion parallel to the yz plane and located so as to be in contact with a side surface, of the side surface member, that is parallel to the yz plane, a sixth flat plate portion facing the fourth flat plate portion while having a space therebetween, and a seventh flat plate portion having the second receiving surface and parallel to the yz plane, wherein a gap is formed between the seventh flat plate portion and the fourth flat plate portion, and the fourth flat plate portion and the fifth flat plate portion are respectively generally parallel with the sixth flat plat portion and the seventh flat plate portion so that the fourth flat plate portion, the fifth flat plate portion, the sixth flat plate portion and the seventh flat plate portion define four respective side surfaces of a generally parallelepiped first space.

2. The container of claim 1, wherein the first flat plate portion, the second flat plate portion, the third flat plate portion and the fourth flat plate portion define four respective surfaces of a generally parallelepiped second space.

3. The container of claim 2, further comprising a first filling member located in the second space.

4. The container of claim 3, wherein the first filling member is formed integrally with the accommodation member.

5. The container of claim 1, wherein the fifth flat plate portion, the sixth flat plate portion and the seventh flat plate portion each independently have a thickness that is less than a thickness of each of the first flat plate portion, the second flat plate portion and third flat plate portion.

6. The container of claim 1, wherein a groove is formed at a joint between the fourth flat plate portion and the fifth flat plate portion.

7. The container of claim 1, further comprising a second filling member located in the first space.

8. The container of claim 7, wherein the second filling member is formed integrally with the accommodation member.

9. The container of claim 1, wherein the accommodation member is formed of an expanded plastic material.

10. The container of claim 1, wherein each of the two protection members is formed of a non-expanded plastic material.

11. The container of claim 1, further comprising a respective protection sheet provided on each of the first and second receiving surfaces of each of the two protection members, wherein each protection sheet is formed of a non-expanded plastic material harder than the protection member.

12. The container of claim 1, wherein the fifth flat plate portion faces the seventh flat plate portion, and the fifth flat plate portion and the seventh flat plate portion each form a right angle with the sixth flat plate portion.

* * * * *